US006686699B2

(12) United States Patent
Yumoto

(10) Patent No.: US 6,686,699 B2
(45) Date of Patent: Feb. 3, 2004

(54) ACTIVE MATRIX TYPE DISPLAY APPARATUS, ACTIVE MATRIX TYPE ORGANIC ELECTROLUMINESCENCE DISPLAY APPARATUS, AND DRIVING METHODS THEREOF

(75) Inventor: Akira Yumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/157,174

(22) Filed: May 29, 2002

(65) Prior Publication Data

US 2002/0195964 A1 Dec. 26, 2002

(30) Foreign Application Priority Data

May 30, 2001 (JP) ..... P2001-161890

(51) Int. Cl.[7] ..... G09G 3/10; G09G 3/30
(52) U.S. Cl. ..... 315/169.3; 345/76
(58) Field of Search ..... 315/169.3, 169.4; 313/498, 500, 501, 505; 345/76, 86, 81, 92

(56) References Cited

U.S. PATENT DOCUMENTS 5,952,789 A 9/1999 Stewart et al. ..... 315/169.4
6,246,180 B1 * 6/2001 Nishigaki ..... 315/169.3
6,351,078 B1 * 2/2002 Wang et al. ..... 315/169.3
6,369,785 B1 * 4/2002 Imai ..... 345/76
6,501,466 B1 * 12/2002 Yamagishi et al. ..... 345/204

FOREIGN PATENT DOCUMENTS

| | | |
|---|---|---|
| EP | 0905673 | 3/1999 |
| EP | 1061497 | 12/2000 |
| WO | WO 98/48403 | 10/1998 |

* cited by examiner

*Primary Examiner*—Don Wong
*Assistant Examiner*—Minh D A
(74) *Attorney, Agent, or Firm*—Sonnenschein, Nath & Rosenthal LLP

(57) ABSTRACT

In an active matrix type organic EL display apparatus, a current bias circuit for feeding a data line with a current in a direction of canceling a writing current is provided for each data line. The current bias circuit includes: a converting unit supplied with information of a value of the driving current to be fed in a form of a current, for converting the supplied current into a form of a voltage; a retaining unit for retaining the voltage obtained by the conversion by the converting unit; and a driving unit for converting the voltage retained by the retaining unit into a current, and feeding the data line with the current as the driving current. The current bias circuit feeds, as a bias current, the driving current in the direction of canceling the brightness data current through each data line, and the value of the bias current is prevented from varying among the data lines. Thus high-speed writing of low brightness data including black data can be realized and an image without black floating can be displayed.

20 Claims, 14 Drawing Sheets

ACTIVE MATRIX TYPE DISPLAY APPARATUS, ACTIVE MATRIX TYPE ORGANIC ELECTROLUMINESCENCE DISPLAY APPARATUS, AND DRIVING METHODS THEREOF

RELATED APPLICATION DATA

The present application claims priority to Japanese Application(s) No(s). P2001-161890 filed May 30, 2001, which application(s) is/are incorporated herein by reference to the extent permitted by law.

BACKGROUND OF THE INVENTION

The present invention relates to an active matrix type display apparatus having an active device in each pixel and controlling display in the pixel unit by means of the active device, and a driving method thereof, and particularly to an active matrix type display apparatus using an electrooptic device that varies brightness according to a current flowing therein, an active matrix type organic EL display apparatus using an organic-material electroluminescence (hereinafter described as organic EL (electroluminescence)) device as the electrooptic device, and driving methods thereof.

A liquid crystal display using a liquid crystal cell as a display device of a pixel, for example, has a large number of pixels arranged in a matrix manner, and controls light intensity in each pixel according to information of an image to be displayed, thereby effecting driving for image display. The same display driving is effected by an organic EL display using an organic EL device as a display device of a pixel and the like.

Since the organic EL display is a so-called self-luminous type display using a light emitting device as a display device of a pixel, however, the organic EL display has advantages such as higher visibility of images, no need for a backlight, and a higher response speed as compared with the liquid crystal display. Moreover, brightness of each light emitting device is controlled by the value of a current flowing therein. That is, the organic EL display differs greatly from the liquid crystal display or the like of a voltage-controlled type, in that the organic EL device is of a current-controlled type.

As with the liquid crystal display, the organic EL display uses a passive matrix method and an active matrix method as its driving method. Although the former has a simple construction, however, the former has problems such as difficulty in realizing a large high-definition display. Thus, the active matrix method has recently been actively developed which controls a current flowing through a light emitting device within a pixel by means of an active device, for example an insulated gate field-effect transistor (typically a thin film transistor; TFT) also disposed within the pixel.

FIG. 1 shows a conventional example of a pixel circuit (circuit of a unit pixel) in an active matrix type organic EL display (for more detailed description, see U.S. Pat. No. 5,684,365 and Japanese Patent Laid-Open No. Hei 8-234683).

As is clear from FIG. 1, the pixel circuit according to the conventional example includes: an organic EL device 101 having an anode connected to a positive power supply Vdd; a TFT 102 having a drain connected to a cathode of the organic EL device 101 and a source connected to a ground (hereinafter described as "grounded"); a capacitor 103 connected between a gate of the TFT 102 and the ground; and a TFT 104 having a drain connected to the gate of the TFT 102, a source connected to a data line 106, and a gate connected to a scanning line 105.

Since the organic EL device has a rectifying property in many cases, the organic EL device may be referred to as an OLED (Organic Light Emitting Diode). Therefore, in FIG. 1 and other figures, a symbol of a diode is used to denote the organic EL device as the OLED. In the following description, however, a rectifying property is not necessarily required of the OLED.

The operation of the thus formed pixel circuit is as follows. First, when potential of the scanning line 105 is brought to a selected state (high level in this case) and a writing potential Vw is applied to the data line 106, the TFT 104 conducts, the capacitor 103 is charged or discharged, and thus a gate potential of the TFT 102 becomes the writing potential Vw. Next, when the potential of the scanning line 105 is brought to a non-selected state (low level in this case), the TFT 102 is electrically disconnected from the scanning line 105, while the gate potential of the TFT 102 is stably retained by the capacitor 103.

A current flowing through the TFT 102 and the OLED 101 assumes a value corresponding to a gate-to-source voltage Vgs of the TFT 102, and the OLED 101 continues emitting light at a brightness corresponding to the value of the current. The operation of selecting the scanning line 105 and transmitting to the inside of the pixel brightness data supplied to the data line 106 will hereinafter be referred to as "writing." As described above, once the pixel circuit shown in FIG. 1 writes the potential Vw, the OLED 101 continues emitting light at a fixed brightness until next writing.

An active matrix type display apparatus (organic EL display) can be formed by arranging a large number of such pixel circuits (which may hereinafter be described simply as pixels) 111 in a matrix manner as shown in FIG. 2, and repeating writing from a voltage driving type data line driving circuit (voltage driver) 114 through data lines 115-1 to **115-*m* while selecting scanning lines 112-1 to 112-*n* sequentially by a scanning line driving circuit 113**. A pixel arrangement of m columns and n rows is shown in this case. Of course, in this case, the number of data lines is m and the number of scanning lines is n.

Each light emitting device in a passive matrix type display apparatus emits light only at an instant when the light emitting device is selected, whereas a light emitting device in an active matrix type display apparatus continues emitting light even after completion of writing. Thus, the active matrix type display apparatus is advantageous especially for use as a large high-definition display in that the active matrix type display apparatus can decrease peak brightness and peak current of the light emitting device as compared with the passive matrix type display apparatus.

In an active matrix type organic EL display, a TFT (thin film field-effect transistor) formed on a glass substrate is generally used as an active device. It is known, however, that amorphous silicon and polysilicon used to form the TFT have inferior crystallinity and inferior controllability of the conducting mechanism to single-crystal silicon, and thus the formed TFT has great variations in characteristics.

When a polysilicon TFT is formed on a relatively large glass substrate, in particular, the polysilicon TFT is generally crystallized by a laser annealing method after formation of an amorphous silicon film, in order to avoid problems such as thermal deformation of the glass substrate. However, it is difficult to irradiate the large glass substrate with uniform laser energy, and thus the crystallized state of the polysilicon is varied depending on a location within the substrate. As a result, the threshold value Vth of even TFTs formed on the same substrate can be varied from pixel to pixel by a few hundred mV, or 1 V or more in some cases.

In that case, even when the same potential Vw is written to different pixels, for example, the threshold value Vth of the TFTs varies from pixel to pixel. This results in great variation from pixel to pixel in the current Ids flowing through the OLED (organic EL device), and hence deviation of the current Ids from a desired value. Therefore high picture quality cannot be expected of the display. This is true for not only variation in the threshold value Vth but also variation in carrier mobility $\mu$ and the like.

In order to remedy such a problem, the present inventor has proposed a current writing type pixel circuit shown in FIG. 3 as an example (see International Publication Number WO01/06484).

As is clear from FIG. 3, the current writing type pixel circuit includes: an OLED 121 having an anode connected to a positive power supply Vdd; an N-channel TFT 122 having a drain connected to a cathode of the OLED 121 and a source grounded; a capacitor 123 connected between a gate of the TFT 122 and the ground; a P-channel TFT 124 having a drain connected to a data line 128, and a gate connected to a scanning line 127; an N-channel TFT 125 having a drain connected to a source of the TFT 124, and a source grounded; and a P-channel TFT 126 having a drain connected to the drain of the TFT 125, a source connected to the gate of the TFT 122, and a gate connected to the scanning line 127.

The thus formed pixel circuit is crucially different from the pixel circuit shown in FIG. 1 in the following respect: in the case of the pixel circuit shown in FIG. 1, brightness data is supplied to the pixel in the form of voltage, whereas in the case of the pixel circuit shown in FIG. 3, brightness data is supplied to the pixel in the form of current.

First, when brightness data is to be written, the scanning line 127 is brought to a selected state (low level in this case), and a current Iw corresponding to the brightness data is passed through the data line 128. The current Iw flows through the TFT 124 to the TFT 125. In this case, let Vgs be a gate-to-source voltage occurring in the TFT 125. Because of a short circuit between the gate and drain of the TFT 125, the TFT 125 operates in a saturation region.

Thus, according to a well-known equation of a MOS transistor, the following holds:

$$Iw=\mu 1 Cox1 W1/L1/2(Vgs-Vth1)^2 \quad (1)$$

In the equation (1), Vth1 is the threshold value of the TFT 125; $\mu 1$ is carrier mobility of the TFT 125; Cox1 is gate capacitance per unit area of the TFT 125; W1 is channel width of the TFT 125; and L1 is channel length of the TFT 125.

Then, letting Idrv be a current flowing through the OLED 121, the current value of the current Idrv is controlled by the TFT 122 connected in series with the OLED 121. In the pixel circuit shown in FIG. 3, a gate-to-source voltage of the TFT 122 coincides with the Vgs in the equation (1), and hence, assuming that the TFT 122 operates in a saturation region, $$Idrv=\mu 2 Cox2 W2/L2/2(Vgs-Vth2)^2 \quad (2)$$

Incidentally, a condition for operation of a MOS transistor in a saturation region is generally known to be:

$$|Vds|>|Vgs-Vt| \quad (3)$$

The meanings of the parameters in the equation (2) and the equation (3) are the same as in the equation (1). Since the TFT 125 and the TFT 122 are formed adjacent to each other within a small pixel, it may be considered that actually $\mu 1=\mu 2$, Cox1=Cox2, and Vth1=Vth2. Then, the following is readily derived from the equation (1) and the equation (2):

$$Idrv/Iw=(W2/W1)/(L2/L1) \quad (4)$$

Specifically, even when the values themselves of the carrier mobility $\mu$, the gate capacitance Cox per unit area, and the threshold value Vth vary within a panel surface or from panel to panel, the current Idrv flowing through the OLED 121 is in exact proportion to the writing current Iw, and consequently luminous brightness of the OLED 121 can be controlled accurately. In particular, when a design is made such that W2=W1 and L2=L1, for example, Idrv/Iw=1, that is, the writing current Iw and the current Idrv flowing through the OLED 121 are of the same value irrespective of variations in the TFT characteristics.

FIG. 4 is a diagram showing another circuit example of a current writing type pixel circuit. The pixel circuit according to the present circuit example is in opposite relation in terms of a transistor conduction type (N channel/P channel) from the pixel circuit according to the circuit example shown in FIG. 3. Specifically, the N-channel TFTs 122 and 125 in FIG. 3 are replaced with P-channel TFTs 132 and 135, and the P-channel TFTs 124 and 126 in FIG. 3 are replaced with N-channel TFTs 134 and 136. The direction of current flow and the like are also different. However, operating principles are exactly the same.

An active matrix type organic EL display apparatus can be formed by arranging the above-described current writing type pixel circuits as shown in FIG. 3 and FIG. 4 in a matrix manner. FIG. 5 shows an example of configuration of the active matrix type organic EL display apparatus.

In FIG. 5, scanning lines 142-1 to **142-*n* are arranged one for each of rows of current writing type pixel circuits 141 corresponding in number with m columns×n rows and disposed in a manner of the matrix. The gate of the TFT 124 in FIG. 3 (or the gate of the TFT 134 in FIG. 4) and the gate of the TFT 126 in FIG. 3 (or the gate of the TFT 136 in FIG. 4) are connected in each pixel to the scanning line 142-1 to 142-*n*. The scanning lines 142-1 to 142-*n* are sequentially driven by a scanning line driving circuit 143**.

Data lines 144-1 to **144-*m* are arranged one for each of the columns of the pixel circuits 141. One end of each of the data lines 144-1 to 144-*m* is connected to an output terminal for each column of a current driving type data line driving circuit (current driver CS) 145. The data line driving circuit 145 writes brightness data to each of the pixels through the data lines 144-1 to 144-*m***.

When such a circuit supplied with brightness data in the form of a current value, that is, a current writing type pixel circuit as shown in FIG. 3 or FIG. 4 is used as a pixel circuit, there is a problem of difficulty in writing low brightness data. In writing data of low brightness extremely close to black, for example, a very small current extremely close to zero is written. In this case, in the circuit example of FIG. 3, impedance of the TFT 125 becomes high, and it takes a long time for potential of the data line having a high parasitic capacitance to be stabilized. This is also true for internal operation of the data line driving circuit 145 of FIG. 5. Therefore, it is generally difficult to supply a very small current quickly and accurately.

The writing of black data means that the value of the writing current is zero, and the writing of complete black takes an infinite time in theory. More specifically, when high brightness data (greater current), for example, is written in a scanning cycle immediately before the writing of black, the data line 128 in FIG. 3 and the data lines 144-1 to **144-*m* in FIG. 5 are at a relatively high potential. When black is written in the immediately succeeding scanning cycle, the potential of the data line is lowered as a result of action of the TFT 125 in FIG. 3. Since the gate-to-source voltage Vgs of the TFT 125 is decreased as the potential is lowered, the driving current is decreased and the lowering of the potential is slowed quickly. Then, in theory, after passage of an infinite time, the potential of the data line becomes the threshold value voltage Vth of the TFT 125**.

Since a practical writing time is finite (commonly one scanning period or less), the gate-to-source voltage of the TFT 122 in FIG. 3 is higher than the threshold value voltage Vth of the TFT 125 at the end of the writing. As described earlier, since the TFT 122 is disposed adjacent to the TFT 125, the threshold value voltage of the TFT 122 is substantially Vth. Therefore, the gate-to-source voltage of the TFT 122 being higher than the threshold value voltage Vth means that the TFT 122 is not completely cut off.

A characteristic (A) in FIG. 6 shows this situation. As a phenomenon, a pixel to which black was to be written actually emits weak light (this phenomenon will hereinafter be described also as "black floating"). One great advantage of the organic EL display which advantage is not possessed by the liquid crystal display is high contrast ratio. The high contrast ratio results from the capability to display complete black by not passing a current through the light emitting device. However, even slight black floating significantly compromises the contrast ratio of an image, and this represents a problem that cannot be ignored.

In order to solve this problem, the present inventor has also proposed in the above-mentioned patent application (see International Publication Number WO01/06484) a technique for enabling high-contrast image display by providing a leak device (which may hereinafter be referred to as a current bias device or current bias circuit) for each data line. FIG. 7 shows an example of the circuit configuration. An N-channel TFT 129 connected between a data line 128 and a ground in FIG. 7 is the leak device. In a simplest case, a fixed potential is supplied as a gate potential Vg of the TFT 129.

The TFT 129 feeds a bias current Ib in a direction of canceling a driving current Id from a data line driving circuit (data line driving circuit 145 in FIG. 5). Therefore, a rate at which the potential of the data line is lowered at the time of writing black as described above is fast, and in particular, the potential of the data line becoming lower than the threshold value voltage vth in a finite time means the capability of complete black writing. Thus, provision of the leak device for each data line enables high-contrast image display. A characteristic (B) in FIG. 6 shows this situation.

However, the conventional technique of providing the leak device for each data line has the following problems. As shown in FIG. 7, it is practical to use a TFT as the leak device (current bias device). As described at the beginning, however, the TFT has great variations in characteristics, and thus the bias current Ib tends to be varied. A real writing current Iw flowing to the pixel in FIG. 7 at the time of writing brightness data is a result of subtraction of the bias current Ib from the current Id driven by the data line driving circuit, so that brightness of the light emitting device is varied among data lines and actually appears as variations in a form of streaks (streak variations) of a display image.

The streak variations appear as a noticeable problem particularly as the current value of the bias current Ib is set higher. It has therefore been impossible to set the bias current Ib to a high current value. Incidentally, while a simple resistive component may be used as the current bias device, it is generally difficult to provide an appropriate resistance value with good accuracy and in a small area, and thus the resistive component is basically no different from the TFT in that it is difficult to control variations.

The present invention has been made in view of the above problems, and it is accordingly an object of the present invention to provide an active matrix type display apparatus, an active matrix type organic EL display apparatus, and driving methods thereof that are capable of high-quality display of black and low brightness gradation without variations of a display image and capable of image display without variations in brightness when a current writing type pixel circuit is used.

SUMMARY OF THE INVENTION

In order to achieve the above object, according to the present invention, there is provided an active matrix type display apparatus comprising: a pixel unit formed by arranging pixel circuits in a matrix manner, the pixel circuits each having an electrooptic device that changes brightness thereof according to a current flowing therein; a data line driving circuit for supplying a writing current of a magnitude corresponding to brightness to each of the pixel circuits via a data line and thereby writing brightness data; and a current driving circuit provided for each data line for feeding the data line with a driving current in a direction of canceling the writing current. The current driving circuit corresponds to current bias circuits in embodiments below. The current driving circuit includes: a converting unit supplied with information of a value of the driving current to be fed in a form of a current, for converting the supplied current into a form of a voltage; a retaining unit for retaining the voltage obtained by the conversion by the converting unit; and a driving unit for converting the voltage retained by the retaining unit into a current, and feeding the data line with the current as the driving current.

In the thus formed active matrix type display apparatus or the active matrix type organic EL display apparatus using an organic EL device as the electrooptic device, when first supplied with information of a driving current value in a form of a current during a period when no data is written to pixels, the current driving circuit converts the current into a form of a voltage and retains the voltage. Then, when data is written to the pixels, the current driving circuit converts the retained voltage into a current and feeds the data line with the current as the driving current in the direction of canceling the writing current, thus using the current as a bias current. In this case, the constant driving current based on the information of the driving current value flows through the data line, and therefore the bias current is not varied among data lines.

DETAILED DESCRIPTION OF PREFERRED EMBODIMENTS

Preferred embodiments of the present invention will hereinafter be described in detail with reference to the drawings.

[First Embodiment]

Figure 8:
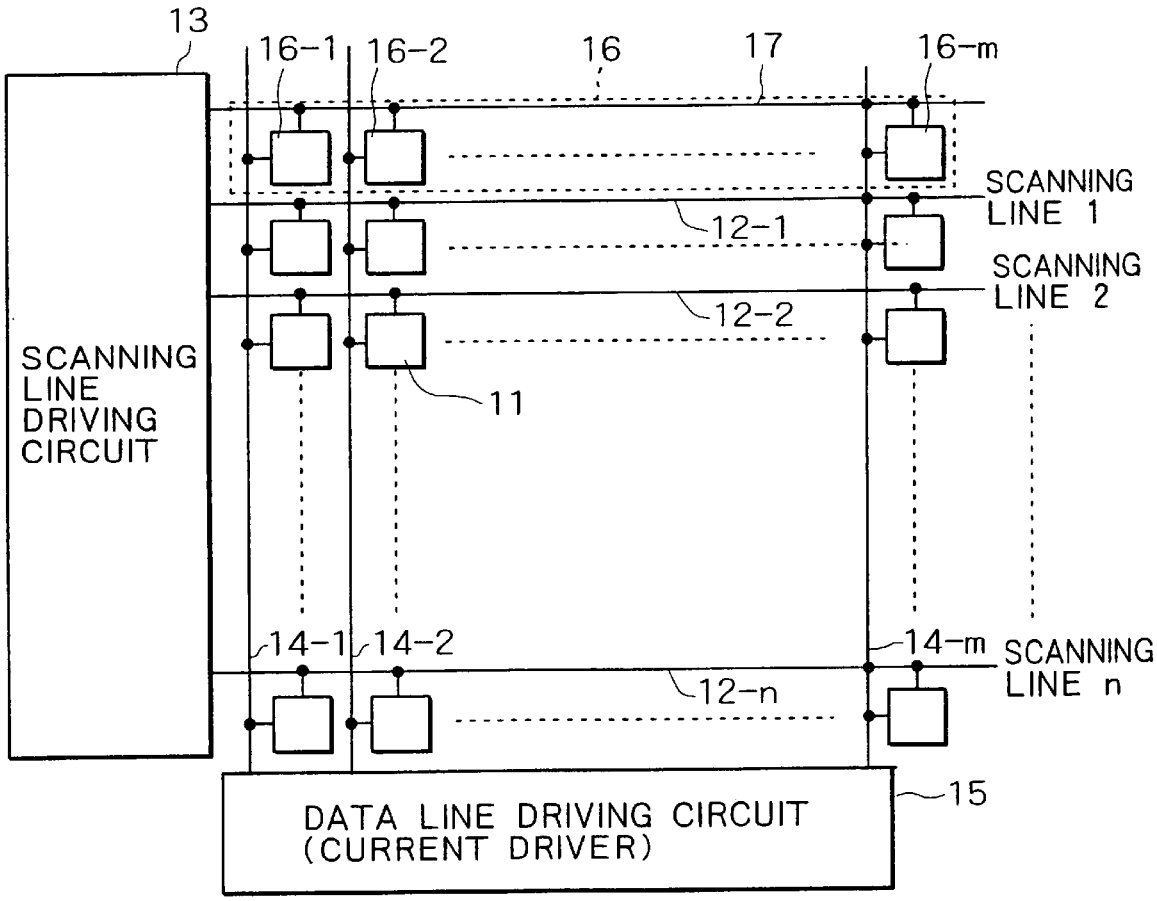
FIG. 8 is a schematic diagram of a configuration of an active matrix type display apparatus according to a first embodiment of the present invention.

FIG. 8 is a schematic diagram of a configuration of an active matrix type display apparatus according to a first embodiment of the present invention. Description in the following will be made by taking as an example a case where an organic EL device is used as an electrooptic device of each pixel, and a field-effect transistor, for example a polysilicon TFT is used as an active device of each pixel so that the present invention is applied to an active matrix type organic EL display apparatus obtained by forming the organic EL device on a substrate where the polysilicon TFT is formed.

Figure 1:
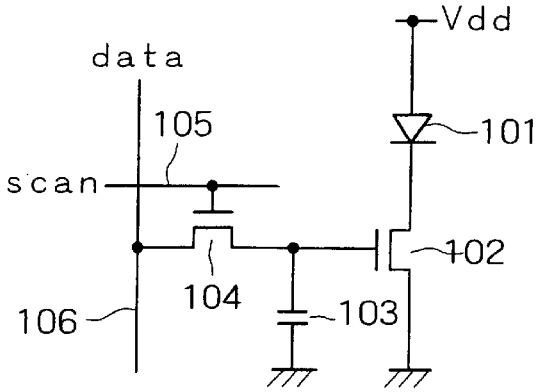
FIG. 1 shows a circuit configuration of a voltage writing type pixel circuit according to a conventional example.
Figure 2:
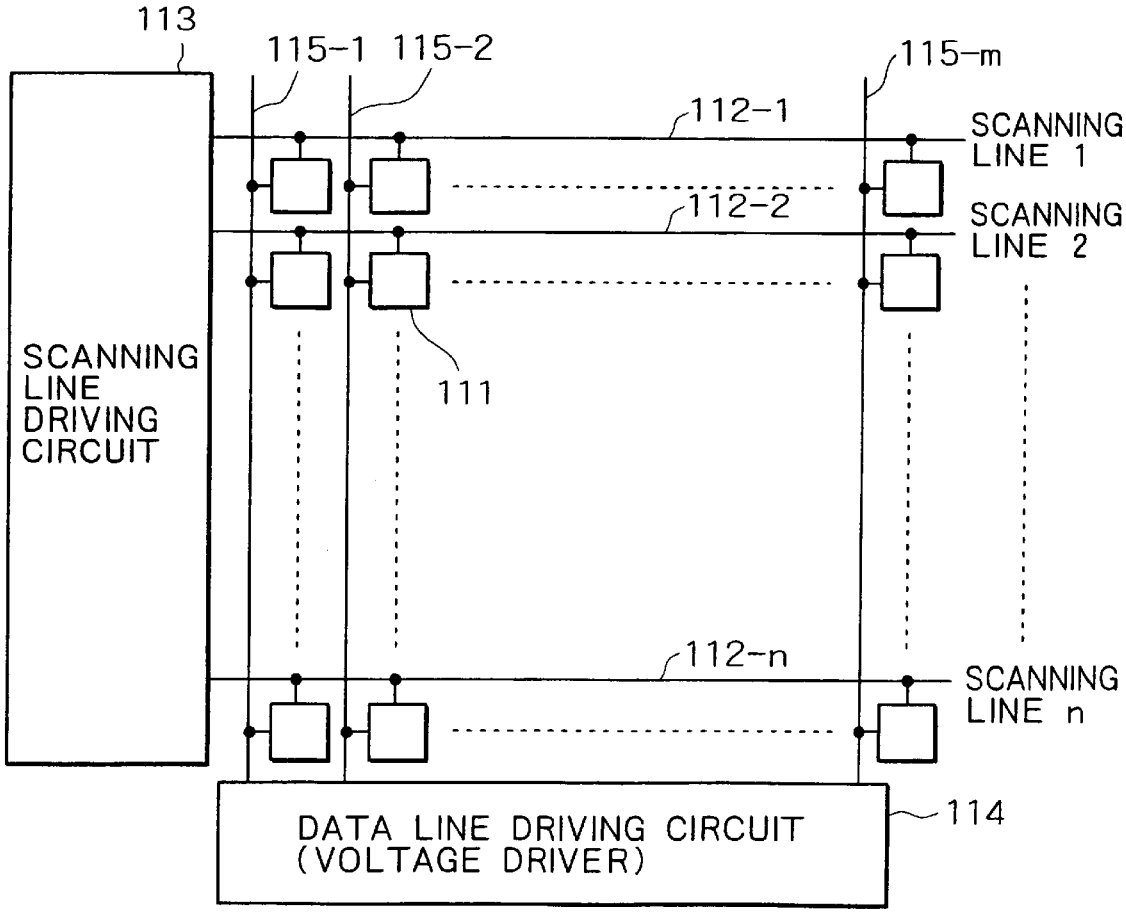
FIG. 2 is a block diagram showing an active matrix type display apparatus using the voltage writing type pixel circuit according to the conventional example.
Figure 3:
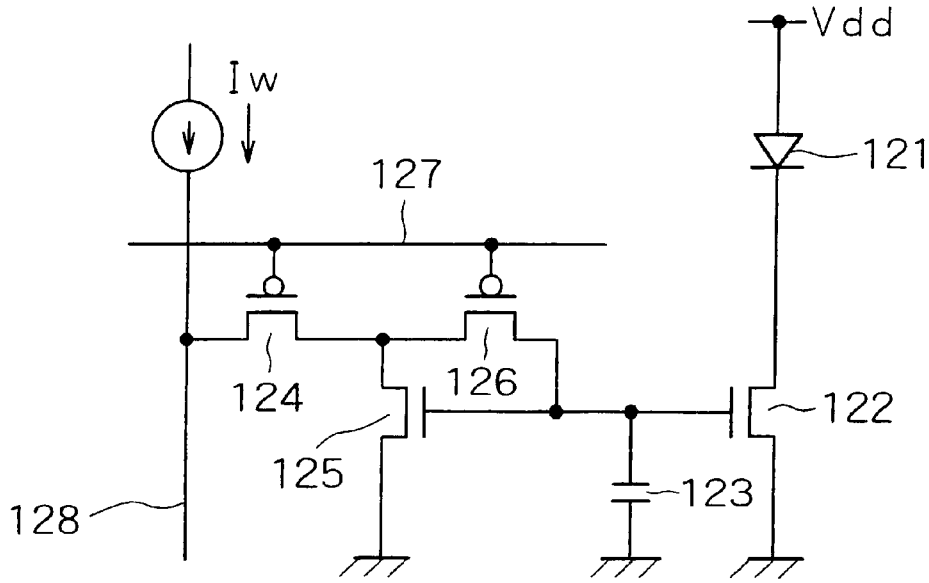
FIG. 3 shows a circuit configuration of a current writing type pixel circuit according to a first conventional example.

In FIG. 8, current writing type pixel circuits 11 corresponding in number with m columns×n rows are arranged in a matrix manner. A circuit of a circuit configuration shown in FIG. 3, for example, is used as a current writing type pixel circuit 11. Scanning lines 12-1 to **12-*n* are arranged one for each of the rows of the pixel circuits 11. The scanning lines 12-1 to 12-*n* are sequentially driven by a scanning line driving circuit 13**.

Data lines 14-1 to **14-*m* are arranged one for each of the columns of the pixel circuits 11. One end of each of the data lines 14-1 to 14-*m* is connected to an output terminal for each column of a current driving type data line driving circuit (current driver) 15. The data line driving circuit 15 writes brightness data to each of the pixel circuits 11 through the data lines 14-1 to 14-*m*. A current bias circuit (current driving circuit) 16 formed by current bias circuits 16-1 to 16-*m* arranged one for each of the data lines 14-1 to 14-*m* is provided on a side opposite from where the data line driving circuit 15 is disposed, for example. A control line 17 is disposed common to the current bias circuits 16-1 to 16-*m* in the current bias circuit 16**.

Figure 9:
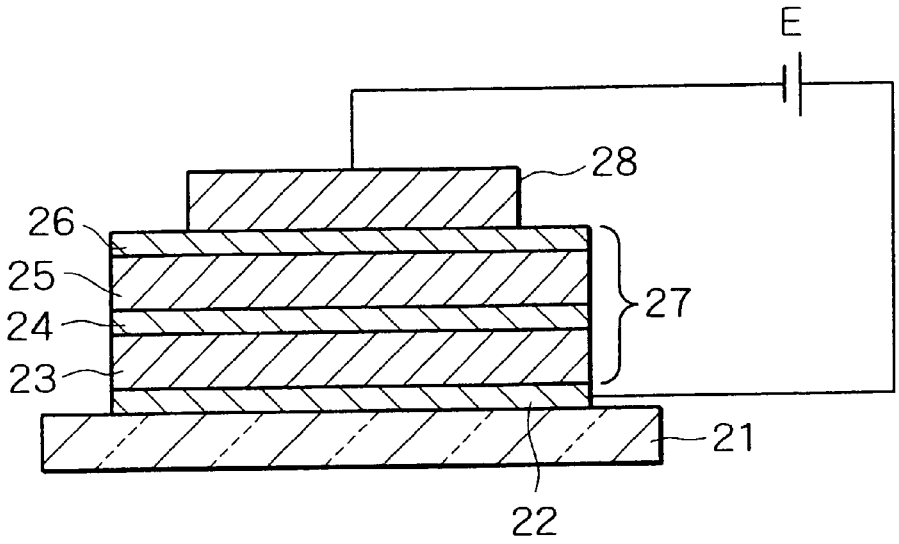
FIG. 9 is a sectional structure diagram showing an example of structure of an organic EL device.

An example of structure of an organic EL device will be described in the following. FIG. 9 shows a sectional structure of an organic EL device. As is clear from FIG. 9, the organic EL device is formed by creating a first electrode (for example anode) 22 made of a transparent conductive film on a substrate 21 made of a transparent glass or the like, further creating an organic layer 27 on the first electrode 22 by depositing a hole carrying layer 23, a light emitting layer 24, an electron carrying layer 25, and an electron injection layer 26 in that order, and then forming a second electrode (for example cathode) 28 made of a metal on the organic layer 27. By applying a direct-current voltage E between the first electrode 22 and the second electrode 28, light is emitted when an electron and a hole are recombined with each other in the light emitting layer 24.

Concrete configurations of the current bias circuit 16 (16-1 to **16-*m***) will be described in the following by taking a few examples.

FIRST CONCRETE EXAMPLE

Figure 10:
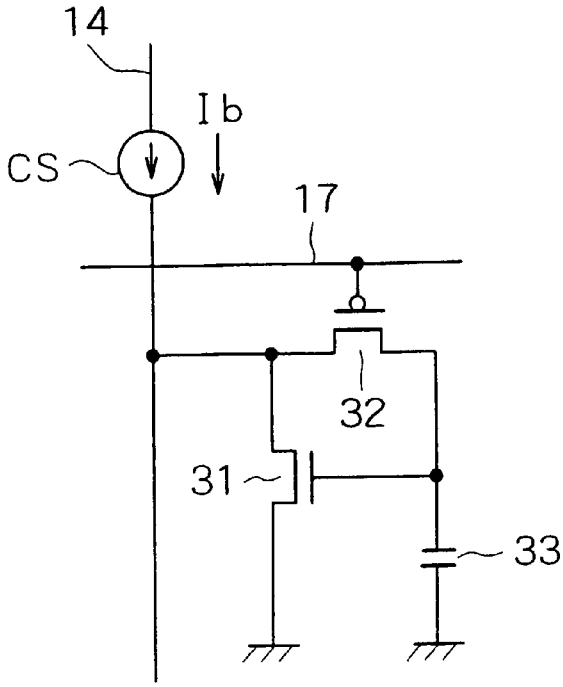
FIG. 10 is a circuit diagram showing a first concrete example of a current bias circuit.

FIG. 10 is a circuit diagram showing a first concrete example of the current bias circuit 16. In FIG. 10, an N-channel TFT 31, for example, is connected between a data line 14 and a ground. A P-channel TFT 32, for example, is connected between a drain and a gate of the TFT 31. A gate of the TFT 32 is connected to a control line 17. A capacitor 33 is connected between the gate of the TFT 31 and the ground.

Circuit operation of the current bias circuit 16 according to the first concrete example will next be described. First, during a vertical blanking period during which no data is written, the control line 17 is set to a low level to thereby bring the TFT 32 into a conducting state, and a current source CS feeds a current Ib through the data line 14. In this case, because of a short circuit caused by the TFT 32 between the gate and drain of the TFT 31, the TFT 31 operates in a saturation region. Incidentally, while the data line driving circuit 15 in FIG. 8 can be used as the current source CS for feeding the current Ib, a current source used exclusively for feeding the current Ib may of course be provided separately from the data line driving circuit 15. The same is true for other concrete examples to be described later.

As the current Ib flows between the drain and source of the TFT 31, then a gate-to-source voltage Vgs corresponding to magnitude of the current Ib occurs according to a MOS transistor characteristic:

$$Ib=\mu CoxW/L/2(Vgs-Vth)^2 \quad (5)$$

where the meanings of the parameters are the same as in the equation (1).

The gate-to-source voltage Vgs of the TFT 31 is stored in the capacitor 33. When in this state, the control line 17 is set to a high level to bring the TFT 32 into a non-conducting state, the capacitor 33 retains the gate-to-source voltage Vgs of the TFT 31. Thereafter, when data is written to each pixel, the TFT 31 converts the voltage retained by the capacitor 33 into a current and feeds the current through the data line 14. In this case, when the TFT 31 operates in a saturation region, the TFT 31 operates as a current source that feeds a current of a value equal to a value of the written current Ib, according to the equation (5).

The parameters in the equation (5) are generally varied among data lines or manufactured panels. However, the value of the current fed by the current bias circuit according to the first concrete example is not dependent on values of these parameters, and is equal to the value of the written current Ib. Thus, the value of the current fed by the current bias circuit according to the first concrete example is not varied among data lines or manufactured panels. In order for the TFT 31 to operate in a saturation region, it is required that the equation (3) hold, that is, potential of the data line be relatively high.

Figure 11:
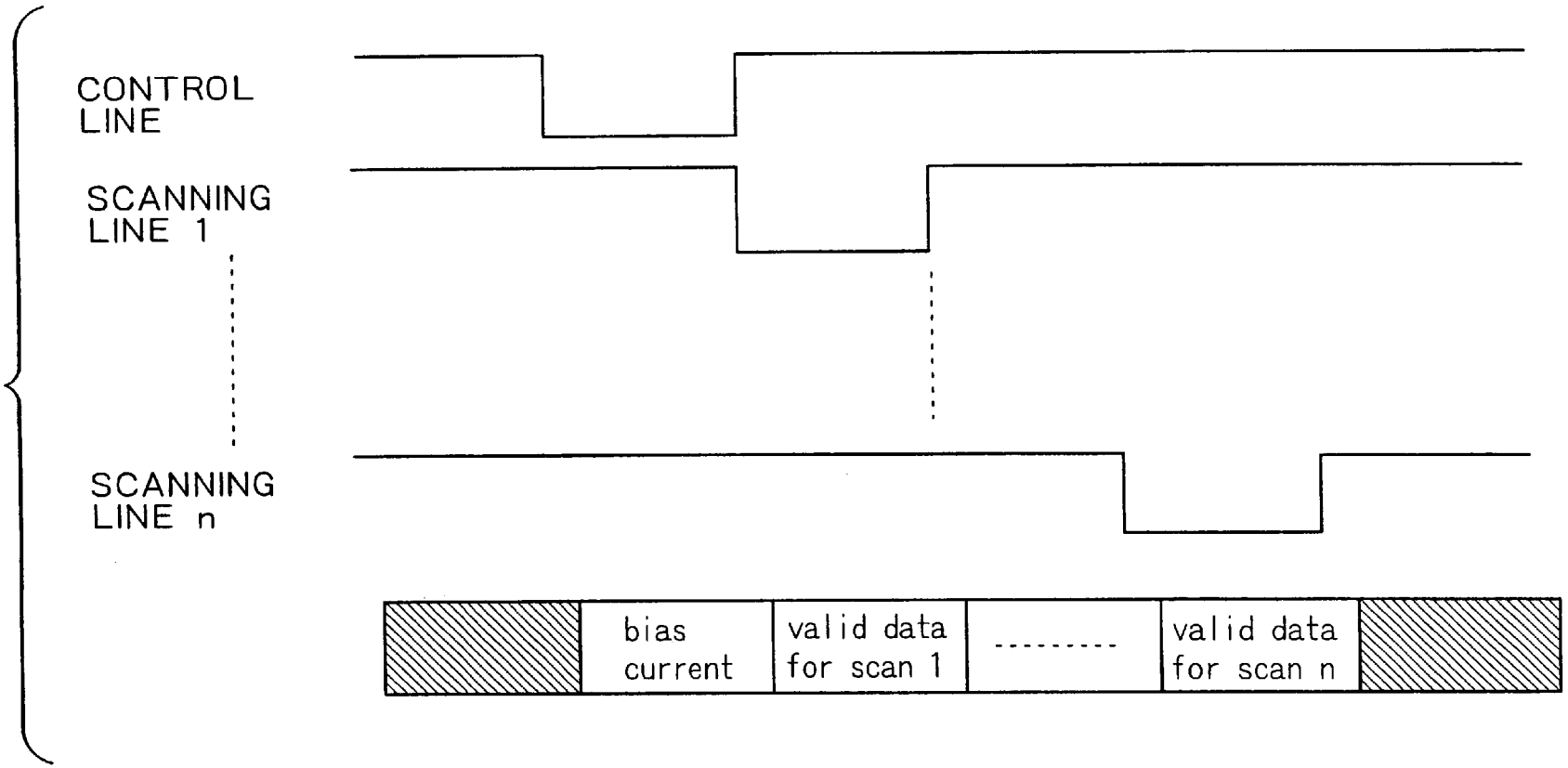
FIG. 11 is a timing chart of assistance in explaining operation of the active matrix type organic EL display apparatus using the current bias circuit according to the first concrete example.

Operation of the active matrix type organic EL display apparatus when the current bias circuit according to the first concrete example is used as the current bias circuits 16-1 to **16-*m* in FIG. 8 will next be described in the following with reference to a timing chart of FIG. 11**.

First, prior to the writing of data to each of the pixel circuits 11, the control line 17 of the current bias circuits 16-1 to **16-*m* is selected (low level in this case). At this point, the data line driving circuit 15 feeds the current Ib to the current bias circuits 16-1 to 16-*m*. The control line 17 is thereafter set to a non-selected state (high level in this case). Unless there is a special reason, the current value of the current Ib is common to the data lines 14-1 to 14-*m***.

Figure 7:
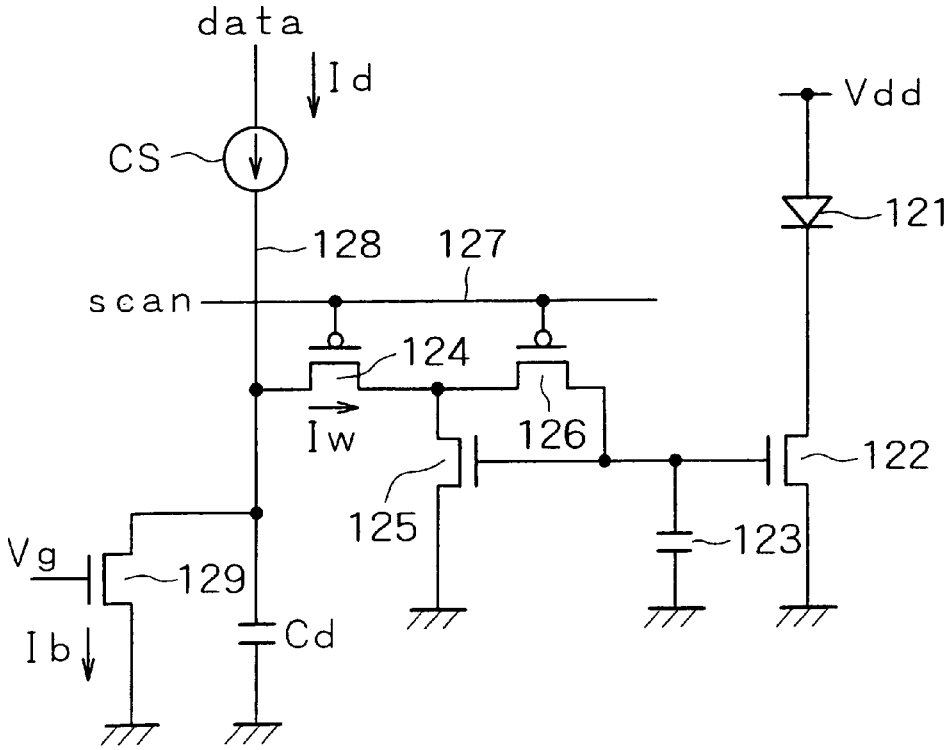
FIG. 7 shows a circuit configuration of a current writing type pixel circuit according to a conventional example using a leak device.

Then, data is written while the scanning lines 12-1 to **12-*n* of the pixel circuits 11 are sequentially selected. In this writing operation, the current bias circuits 16-1 to 16-*m* keep feeding the current Ib, as described above. Thus, the active matrix type organic EL display apparatus shown in FIG. 8 is capable of high-quality black level display, as described with reference to FIG. 7**, and is also free from streak variations of a display image caused by variations in the characteristics of the TFT.

In addition, when writing a bias current value to the current bias circuits 16-1 to **16-*m*, the organic EL display apparatus according to the first embodiment is configured to use the data line driving circuit 15 and the data lines 14-1 to 14-*m* used for writing brightness data as they are. Therefore, the organic EL display apparatus according to the first embodiment has another advantage in that the configuration is hardly complicated as compared with the organic EL display apparatus according to the conventional example shown in FIG. 5**.

Incidentally, it is rational to write a bias current value to the current bias circuits 16-1 to **16-*m* for each frame using a vertical blanking period, during which no data is written to the pixel circuits 11**.

SECOND CONCRETE EXAMPLE

Figure 12:
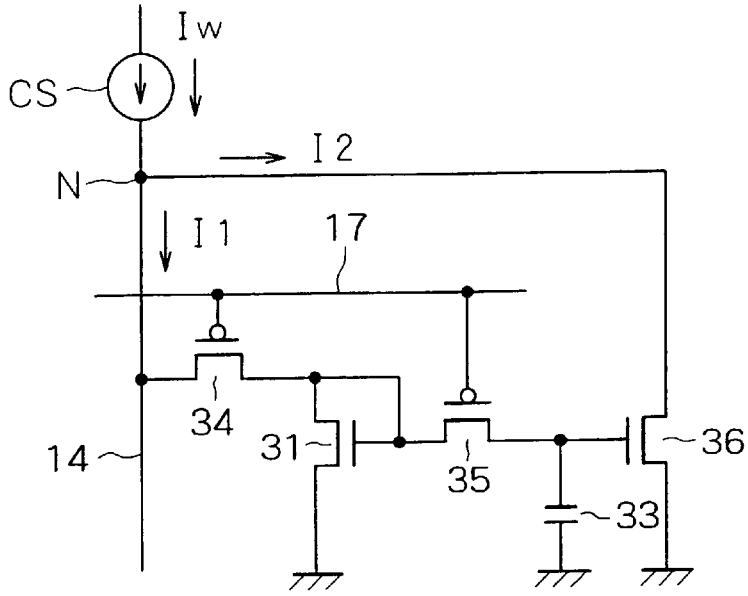
FIG. 12 is a circuit diagram showing a second concrete example of the current bias circuit.

FIG. 12 is a circuit diagram showing a second concrete example of the current bias circuit 16.

In FIG. 12, a gate and a drain of a TFT 31 are connected to a common point. A P-channel TFT 34, for example, is connected between the drain (gate) of the TFT 31 and a data line 14. A source of a P-channel TFT 35, for example, is connected to the gate (drain) of the TFT 31. Gates of the TFTs 34 and 35 are connected to a control line 17.

A capacitor 33 is connected between a drain of the TFT 35 and a ground. A gate of an N-channel TFT 36, for example, is connected to the drain of the TFT 35. The TFT 36 has a drain connected to the data line 14 and a source grounded. The TFT 31 and the TFT 36 are disposed adjacent to each other, and thereby have substantially the same transistor characteristics, thus forming a current mirror circuit.

Circuit operation of the current bias circuit 16 according to the second concrete example will next be described. First, the control line 17 is set to a low level to thereby bring the TFT 34 and the TFT 35 into a conducting state, and a current source CS feeds a current Iw through the data line 14. Because of a short circuit between the gate and drain of the TFT 31, the TFT 31 operates in a saturation region. The current Iw is divided into a current I1 and a current I2 at a node N. Then, the current I1 flows through the TFT 34 in a conducting state to the TFT 31, while the current I2 flows to the TFT 36.

Since the gates of the TFT 31 and the TFT 36 are allowed to be at the same potential by the TFT 35 in a conducting state, the following equations hold:

$$I1=\mu CoxW1/L1/2(Vgs-Vth)^2 \quad (6)$$

$$I2=\mu CoxW2/L2/2(Vgs-Vth)^2 \quad (7)$$

$$Iw=I1+I2 \quad (8)$$

where the meanings of the parameters are the same as in the equation (1). Since the TFT 31 and the TFT 36 are disposed adjacent to each other, it is assumed that the TFT 31 and the TFT 36 are equal to each other in the carrier mobility $\mu$, the gate capacitance Cox per unit area, and the threshold value voltage Vth.

The following equation can be readily derived from the equations (6) to (8).

$$I2=(W2/L2)/(W1/L1+W2/L2)\cdot Iw \quad (9)$$

A gate-to-source voltage Vgs of the TFT 31 is stored in the capacitor 33 via the TFT 35. When in this state, the control line 17 is set to a high level to bring the TFT 34 and the TFT 35 into a non-conducting state, the capacitor 33 retains the gate-to-source voltage Vgs of the TFT 31. Therefore, when the TFT 36 operates in a saturation region, the TFT 36 operates as a current source that feeds the current I2 given by the equation (9).

Thus, although the mobility $\mu$, the gate capacitance Cox, and the threshold value voltage Vth in the equation (6) and the equation (7) are generally varied among data lines or manufactured panels, the value of the current fed by the current bias circuit according to the second concrete example is not dependent on these parameters, and is equal to the current I2. Since the current I2 represents a bias current value, the following is obtained by replacing the current I2 in the equation (9) with a current Ib.

$$Ib=(W2/L2)/(W1/L1+W2/L2)\cdot Iw \quad (10)$$

The bias current value Ib does not vary among data lines or manufactured panels.

While the writing current Iw coincides with the bias current Ib in the current bias circuit according to the first concrete example in FIG. 10, the current bias circuit according to the second concrete example in FIG. 12 is characterized in that a ratio between the writing current Iw and the bias current Ib can be controlled by setting channel lengths and channel widths of the TFT 31 and the TFT 36 forming the current mirror circuit, that is, by setting a mirror ratio. Incidentally, in order for the TFT 36 to operate in a saturation region, it is required that the equation (3) hold, that is, potential of the data line be relatively high.

(First Modification of Second Concrete Example)

Figure 13:
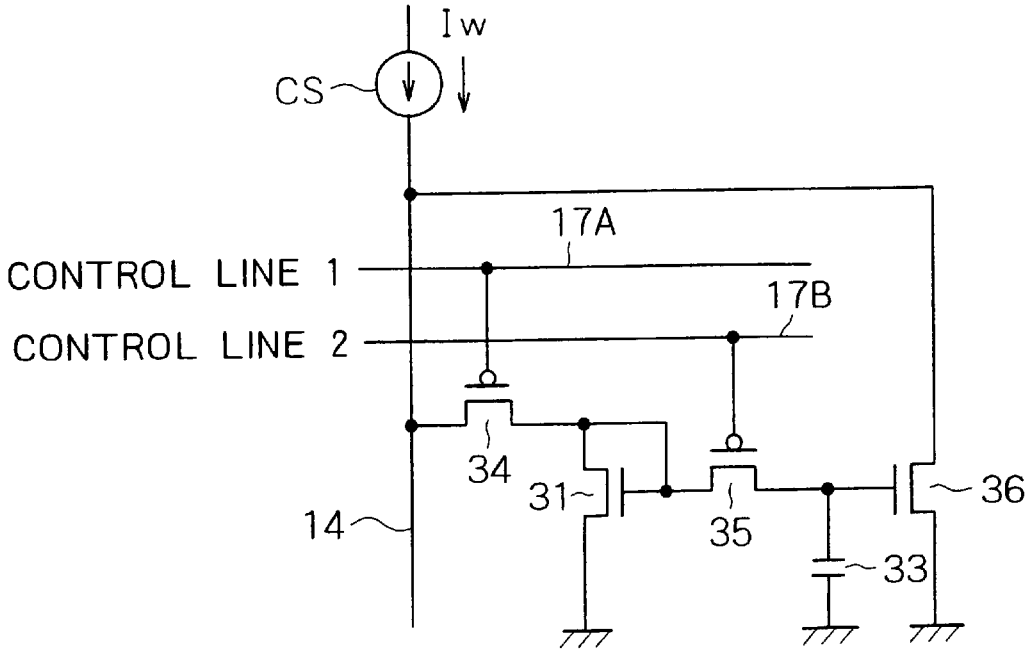
FIG. 13 is a circuit diagram showing a first modification of the second concrete example.
Figure 14:
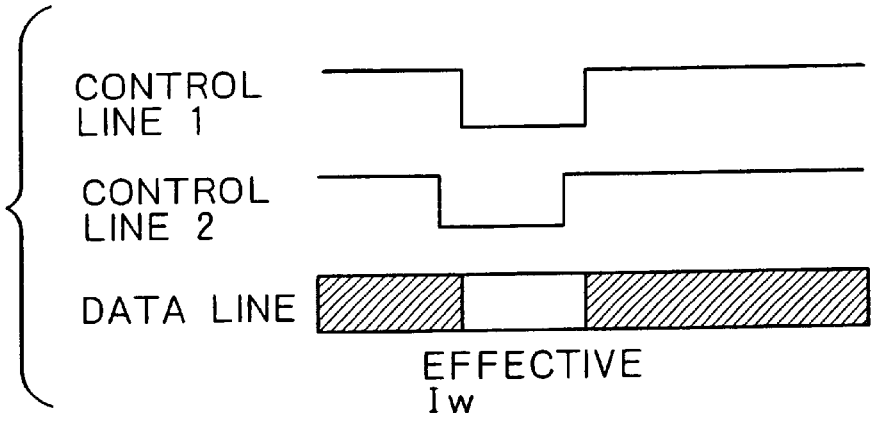
FIG. 14 is a timing chart of the first modification.

While the current bias circuit according to the second concrete example is configured to control the TFT 34 and the TFT 35 by the same control line 17, the current bias circuit according to the second concrete example may be configured to control the TFT 34 and the TFT 35 by separate control lines 17A and 17B (control lines 1 and 2), as shown in FIG. 13. In this case, as shown in a timing chart of FIG. 14, the control line 2 (17B) for controlling the TFT 35 is brought into a non-selected state prior to the control line 1 (17A) for controlling the TFT 34.

Thus, since the TFT 35 is brought into a non-conducting state prior to the TFT 34 under control by the separate control lines 17A and 17B of the TFT 34 and the TFT 35, there is no fear that, as in the case of the current bias circuit according to the second concrete example, impedance of the TFT 34 is increased and the predetermined current Iw does not flow to the TFT 31 at a moment when the control line 17 is brought into a non-selected state. Hence, a more reliable operation can be performed.

(Second Modification of Second Concrete Example)

Figure 15:
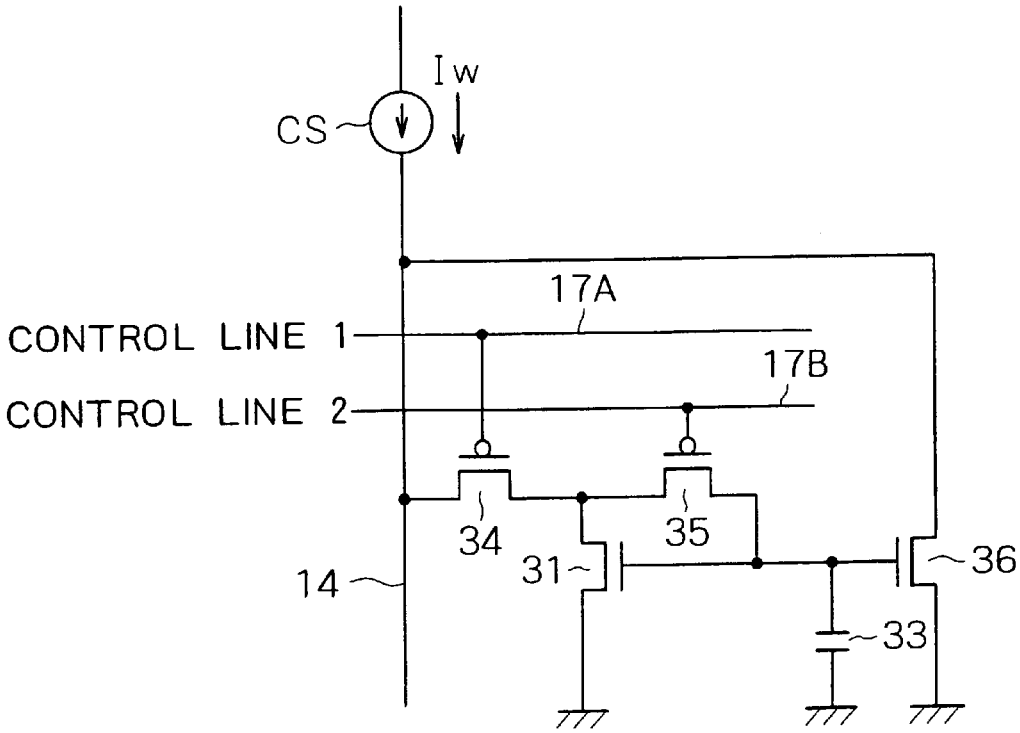
FIG. 15 is a circuit diagram showing a second modification of the second concrete example.

The current bias circuit according to the second concrete example is configured such that the gate and drain of the TFT 31 are directly short-circuited, and the TFT 35 is inserted between the gate (drain) of the TFT 31 and the gate of the TFT 36. However, as shown in FIG. 15, even when configured such that the gate of the TFT 31 and the gate of the TFT 36 are directly connected to each other and the TFT 35 is inserted between the gate and drain of the TFT 31, the current bias circuit according to the second concrete example can perform exactly the same operation.

THIRD CONCRETE EXAMPLE

Figure 16:
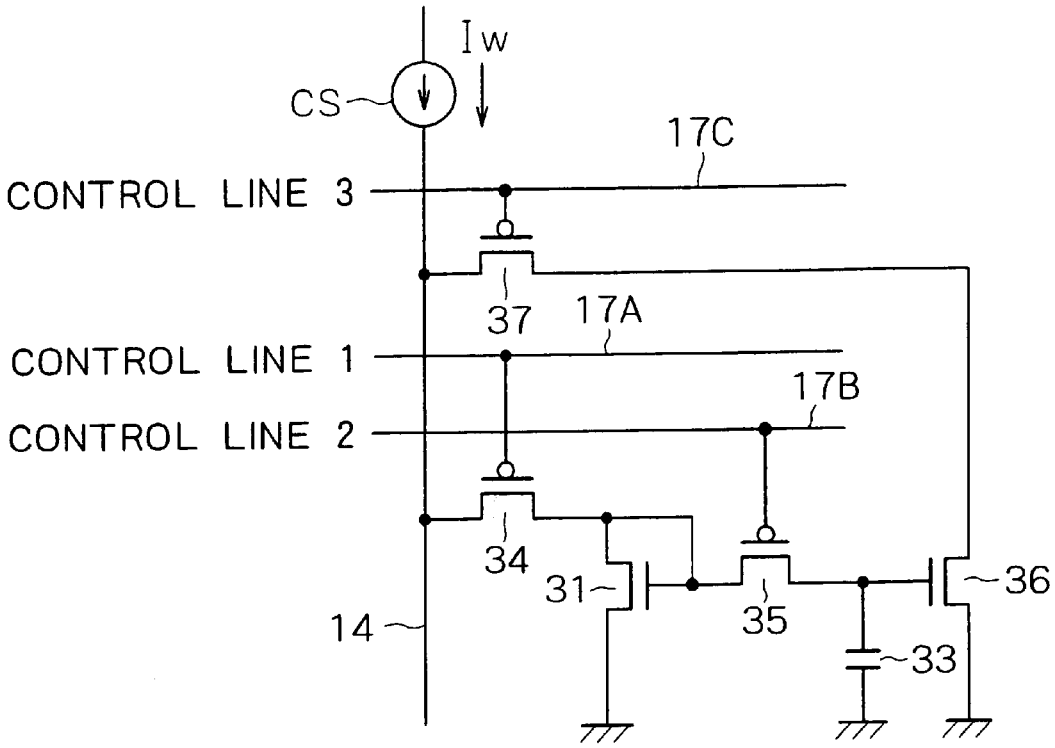
FIG. 16 is a circuit diagram showing a third concrete example of the current bias circuit.

FIG. 16 is a circuit diagram showing a third concrete example of the current bias circuit 16.

Figure 17:
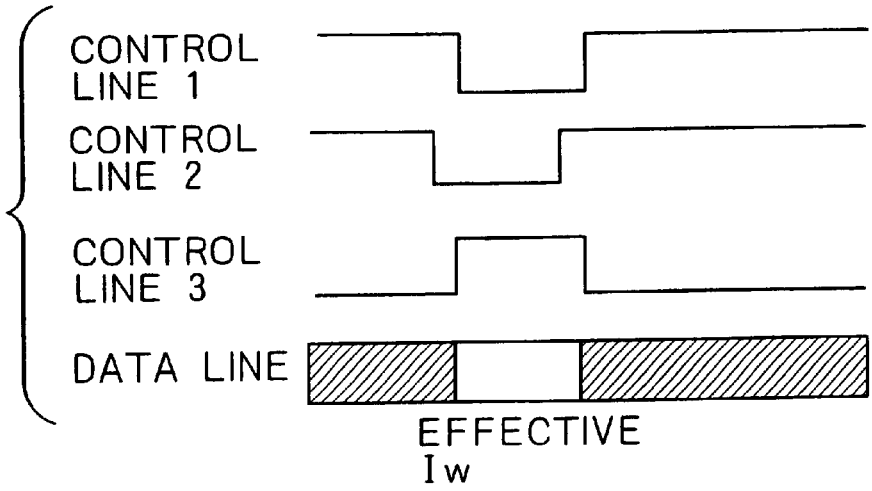
FIG. 17 is a timing chart of the third concrete example.

In the third concrete example, in addition to the configuration according to the first modification of the second concrete example, a P-channel TFT 37, for example, is inserted between the data line 14 and the drain of the TFT 36, and the TFT 37 is controlled by a control line 17C (control line 3). As shown in a timing chart of FIG. 17, the control line 3 is set to a high level when the control line 1 is set to a low level.

Thus, when the control line 1 is set to the low level to thereby bring the TFT 34 into a conducting state for writing, the control line 3 is set to the high level to thereby bring the TFT 37 into a non-conducting state, so that a writing current Iw does not flow to the TFT 36. Hence, $$Iw=\mu CoxW1/L1/2(Vgs-Vth)^2 \quad (11)$$

$$Ib=\mu CoxW2/L2/2(Vgs-Vth)^2 \quad (12)$$

Thus, the following is obtained.

$$Ib=(W2/L2)/(W1/L1)\cdot Iw \quad (13)$$

This means that while as is clear from the equation (10), the bias current Ib is inevitably lower than the writing current Iw in the current bias circuit according to the first modification of the second concrete example, the current bias circuit according to the third concrete example allows the ratio between the bias current Ib and the writing current Iw to be selected freely. Furthermore, operation of the present current bias circuit can be stopped as required by setting the control line 3 to the high level.

In the concrete examples of the current bias circuit 16 and modifications thereof as described above, the circuits are formed by using mainly P-channel MOS transistors as switch transistors, and using mainly N-channel MOS transistors as the other transistors. However, this is a mere example, and application of the present invention is not limited to this.

[Second Embodiment]

Figure 18:
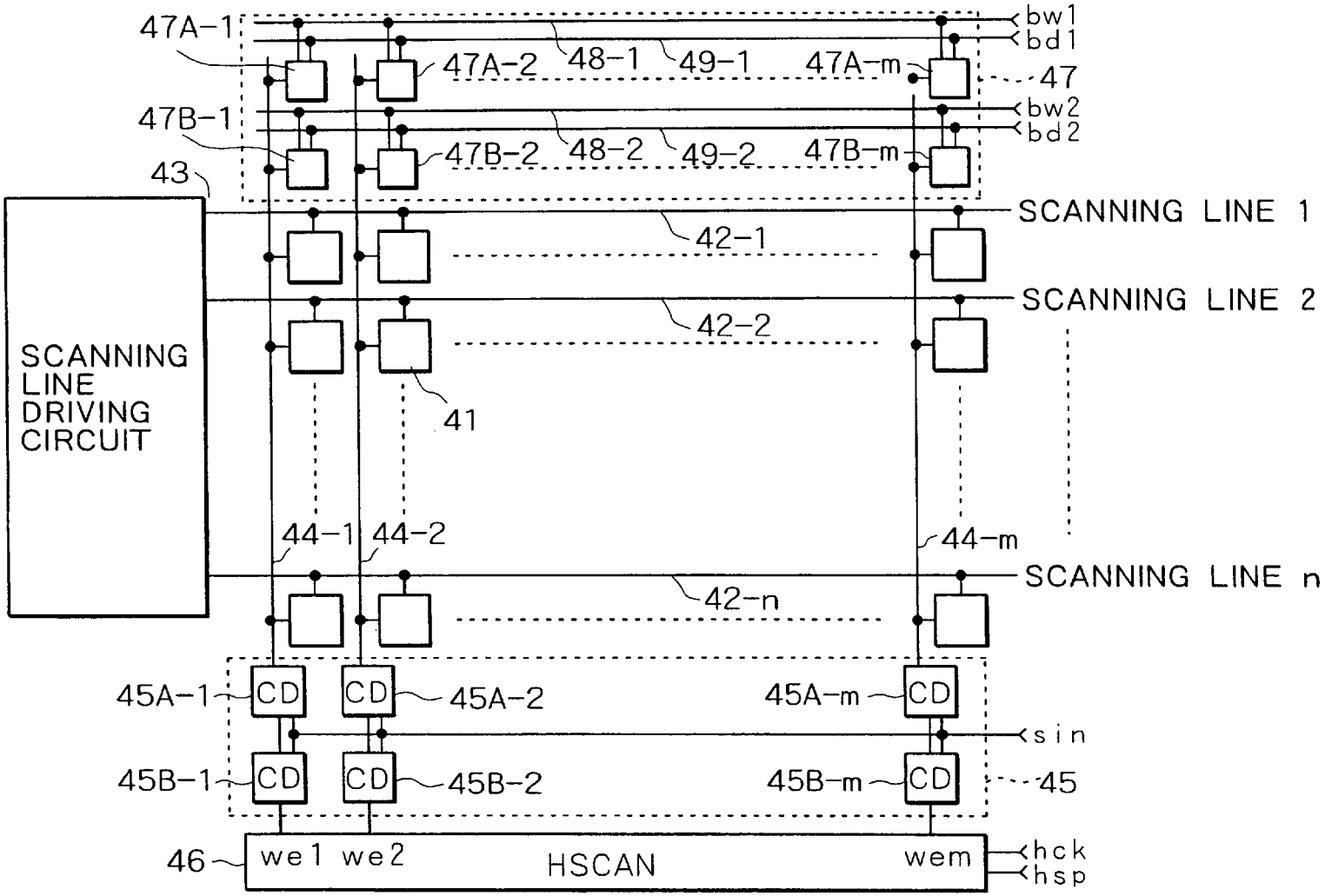
FIG. 18 is a schematic diagram of a configuration of an active matrix type display apparatus according to a second embodiment of the present invention.

FIG. 18 is a schematic diagram of a configuration of an active matrix type display apparatus according to a second embodiment of the present invention. Also in the second embodiment, as in the first embodiment, description will be made by taking as an example a case where an organic EL device is used as an electrooptic device of each pixel, and a field-effect transistor, for example a polysilicon TFT is used as an active device of each pixel so that the present invention is applied to an active matrix type organic EL display apparatus obtained by forming the organic EL device on a substrate where the polysilicon TFT is formed.

Figure 4:
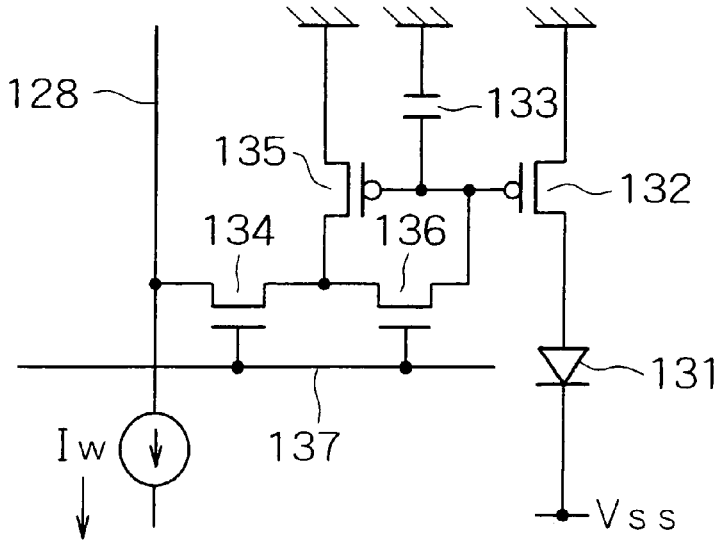
FIG. 4 shows a circuit configuration of a current writing type pixel circuit according to a second conventional example.

In FIG. 18, current writing type pixel circuits 41 corresponding in number with m columns×n rows are arranged in a matrix manner. A circuit of a circuit configuration shown in FIG. 4, for example, is used as a current writing type pixel circuit 41. Scanning lines 42-1 to **42-*n* are arranged one for each of the rows of the pixel circuits 41. The scanning lines 42-1 to 42-*n* are sequentially driven by a scanning line driving circuit 43**.

Data lines 44-1 to **44-*m* are arranged one for each of the columns of the pixel circuits 41. One end of each of the data lines 44-1 to 44-*m* is connected to an output terminal for each column of a current driving type data line driving circuit (current driver) 45. The data line driving circuit 45 writes brightness data to each of the pixel circuits 41 through the data lines 44-1 to 44-*m***.

In the second embodiment, the data line driving circuit 45 is formed by two rows (two systems) of current drivers (CD) 45A-1 to **45A-*m* and 45B-1 to 45B-*m*. The two rows of current driver circuits 45A-1 to 45A-*m* and 45B-1 to 45B-*m* are externally supplied with brightness data sin. Also, the two rows of current driver circuits 45A-1 to 45A-*m* and 45B-1 to 45B-*m*** are controlled for driving operation by two systems of driving control signals that are reversed in polarity in a cycle of one scanning line period and are opposite to each other in phase.

A horizontal scanner (HSCAN) 46 is provided for horizontal scanning of the two rows of current driver circuits 45A-1 to **45A-*m* and 45B-1 to 45B-*m*. The horizontal scanner 46 is supplied with a horizontal start pulse hsp and a horizontal clock signal hck. The horizontal scanner 46 is formed by a shift register, for example, and sequentially generates one system of writing control signals we1 to wem in such a manner as to correspond to transitions (rising edges and falling edges) of the horizontal clock signal hck after being supplied with the horizontal start pulse hsp. The system of writing control signals we1 to wem is supplied to the two rows of current driver circuits 45A-1 to 45A-*m* and 45B-1 to 45B-*m***.

Thus, by forming the data line driving circuit 45 with the two rows (two systems) of current drivers 45A-1 to **45A-*m* and 45B-1 to 45B-*m*, the two rows of current drivers 45A-1 to 45A-*m* and 45B-1 to 45B-*m* can be operated so as to alternate between a written state and a driving state each time the scanning line is changed. This makes it possible to secure substantially one scanning period of time for writing to the data line driving circuit 45 and substantially one scanning period of time for driving the data lines 44-1 to 44-*m***, whereby reliable operation can be performed.

In the second embodiment, a current bias circuit 47 provided on a side opposite from where the data line driving circuit 45 is disposed, for example, is also formed by two rows (two systems) of current bias circuits 47A-1 to **47A-*m* and 47B-1 to 47B-*m* arranged two for each of the data lines 44-1 to 44-*m* so as to correspond to the two rows of current drivers 45A-1 to 45A-*m* and 45B-1 to 45B-*m* forming the data line driving circuit 45**.

Two systems of control lines, that is, a writing control line 48 (48-1 and 48-2) and a driving control line 49 (49-1 and 49-2) are each provided for the two rows of current bias circuits 47A-1 to **47A-*m* and 47B-1 to 47B-*m*. A circuit of a circuit configuration shown in FIG. 19, for example, is used as the current bias circuit 47 (47A-1 to 47A-*m* and 47B-1 to 47B-*m***).

Figure 19:
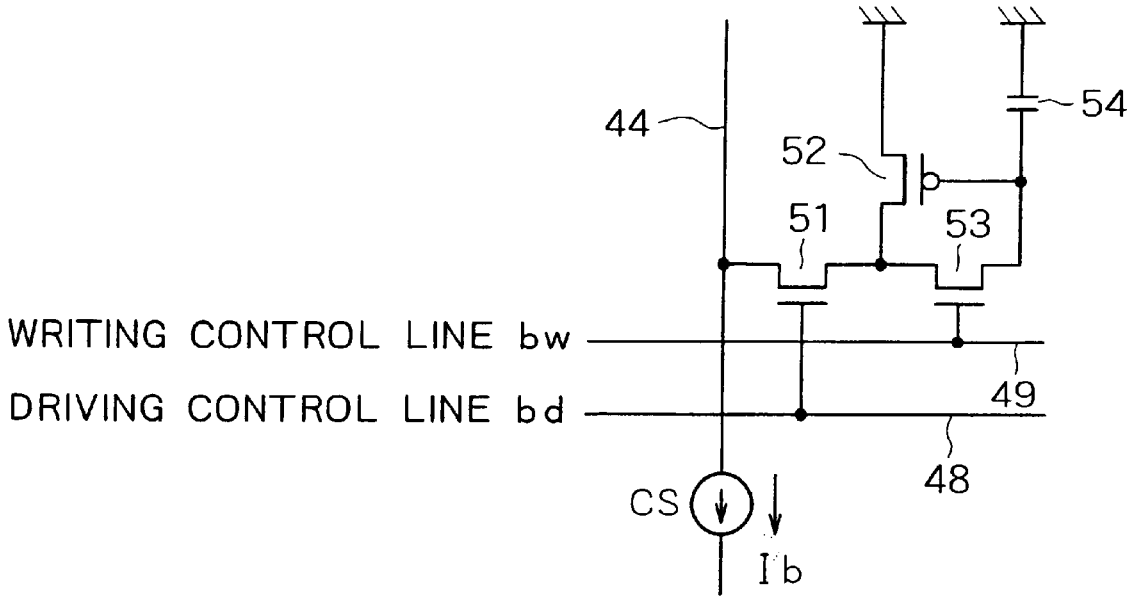
FIG. 19 is a circuit diagram showing a concrete example of a current bias circuit.

In FIG. 19, a drain of an N-channel TFT 51, for example, is connected to the data line 44. A gate of the TFT 51 is connected to a driving control line 48. A P-channel TFT 52, for example, is connected between a source of the TFT 51 and a ground. An N-channel TFT 53, for example, is connected between a drain and a gate of the TFT 52. A gate of the TFT 53 is connected to a writing control line 49. A capacitor 54 is connected between the gate of the TFT 52 and the ground.

Fundamental configuration and operation of the current bias circuit 47 according to the above concrete example are the same as those of the current bias circuit 16 according to the first concrete example as shown in FIG. 10, but a direction of flow of data current of the current bias circuit 47 according to the above concrete example is different from that of the current bias circuit 16 according to the first concrete example. Correspondingly, the current bias circuit 47 is in opposite relation in terms of a transistor conduction type (N channel/P channel) from the current bias circuit 16 according to the first concrete example. Also, the current bias circuit 47 is different in configuration from the current bias circuit 16 according to the first concrete example in that the TFT 51 is inserted between the data line 44 and the current bias circuit 47.

Figure 20:
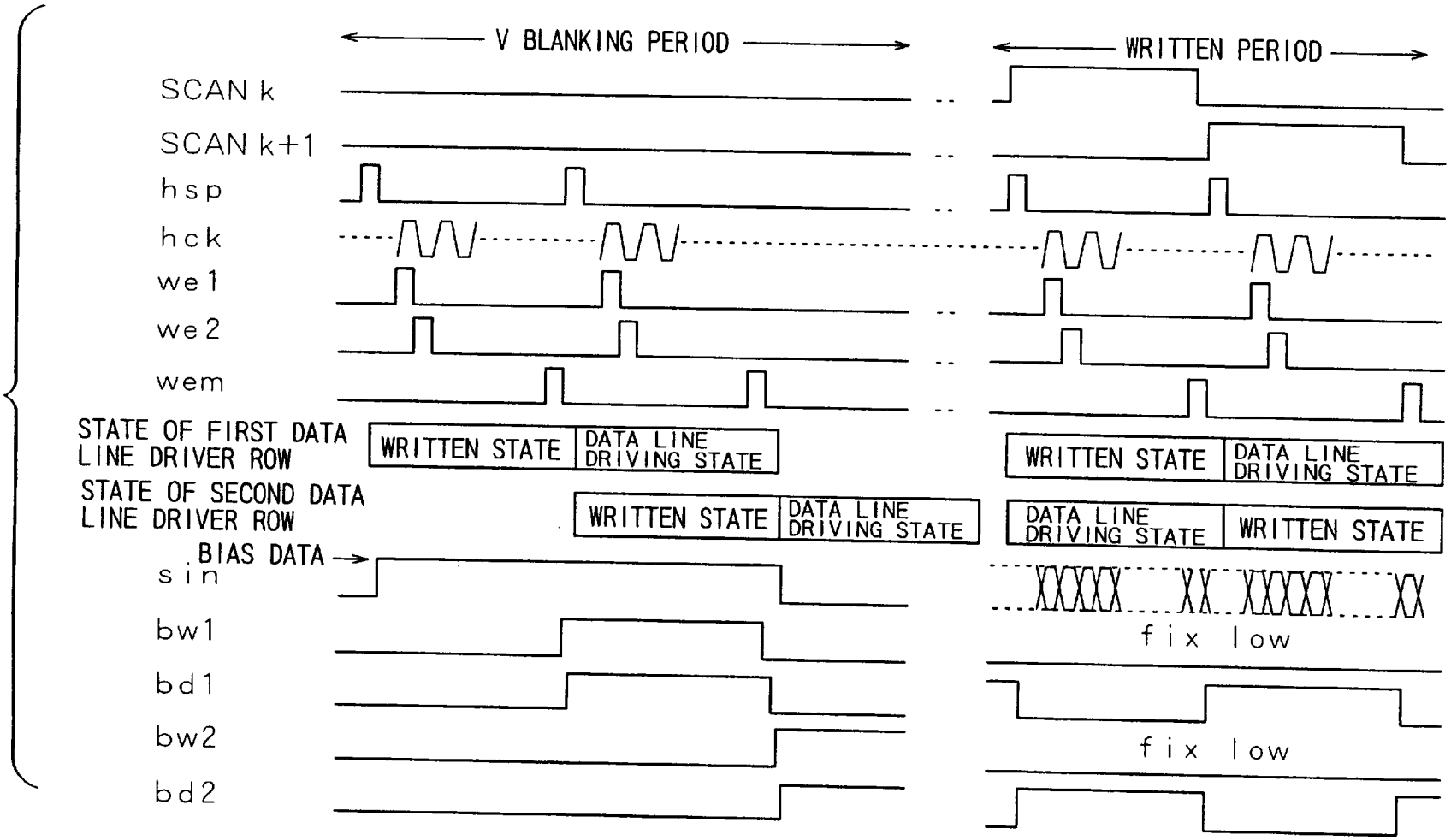
FIG. 20 is a timing chart of assistance in explaining operation of the active matrix type display apparatus according to the second embodiment.

Operation of the thus formed active matrix type organic EL display apparatus according to the second embodiment will next be described with reference to a timing chart of FIG. 20.

First, during a period when the current drivers 45A-1 to **45A-*m* in the first row are in a written state within a vertical blanking period, bias data (high level of brightness data sin) is written to the current drivers 45A-1 to 45A-*m*. The bias data may be supplied in a form of voltage or in a form of current. Subsequently, by bringing the current drivers 45A-1 to 45A-*m* in the first row into a data line driving state and setting both the writing control line bw1 (48-1) and the driving control line bd1 (49-1) to a high level, a bias current Ib is written to the current bias circuits 47A-1 to 47A-*m*** in the first row.

Similarly, during a period when the current drivers 45B-1 to **45B-*m* in the second row are in a written state, the bias current is written to the current drivers 45B-1 to 45B-*m*. Subsequently, by bringing the current drivers 45B-1 to 45B-*m* in the second row into a data line driving state and setting both the writing control line bw2 (48-2) and the driving control line bd2 (49-2) to a high level, the bias current Ib is written to the current bias circuits 47B-1 to 47B-*m*** in the second row.

In a scanning cycle for driving by the current drivers 45A-1 to **45A-*m* in the first row within a brightness data writing period, the driving control line bd1 is set to a high level, that is, the current bias circuits 47A-1 to 47A-*m* in the first row are set to operate. In a scanning cycle for driving by the current drivers 45B-1 to 45B-*m* in the second row, the driving control line bd2 is set to a high level, that is, the current bias circuits 47B-1 to 47B-*m*** in the second row are set to operate.

The data line driving circuit 45 generates the bias current Ib in correspondence with the given bias data. A current value of the bias current Ib, however, may vary among the circuits (data lines) due to variations in the characteristics of the TFT and the like.

On the other hand, in the first embodiment (FIG. 8), the bias current and image data current are generated by the single data line driving circuit 15, and therefore an error in the bias current value is cancelled. Specifically, the generated bias current value Ib is first written to the current bias circuits 16-1 to **16-*m* disposed one for each of the data lines 14-1 to 14-*m*, and retained by the current bias circuits 16-1 to 16-*m***.

Subsequently, when brightness data equal to the bias data is given to the data line driving circuit 45 during the writing of brightness data, the data line driving circuit 45 generates a driving current equal to the bias current value Ib. In this case, since the current bias circuits 16-1 to **16-*m* feed the current for canceling the driving current through the data lines 14-1 to 14-*m*, the value of a current written to the pixel circuits 11** is zero regardless of the bias current value Ib.

Thus, when brightness data equal to the bias data is given to the data line driving circuit 45, it is possible to realize accurate black levels and gradation around the black levels throughout the data lines regardless of variations present in the data line driving circuit 45, and thus display an image with smaller variations in brightness.

The second embodiment can provide the same effects because in the active matrix type organic EL display apparatus provided with the two rows of current drivers 45A-1 to **45A-*m* and 45B-1 to 45B-*m* as the data line driving circuit 45, the two rows of current bias circuits 47A-1 to 47A-*m* and 47B-1 to 47B-*m* are provided to retain the bias current values generated by the two rows of current drivers 45A-1 to 45A-*m* and 45B-1 to 45B-*m*, and the two rows of current bias circuits 47A-1 to 47A-*m* and 47B-1 to 47B-*m* are set to operate in synchronism with operations of the current drivers 45A-1 to 45A-*m* and 45B-1 to 45B-*m***, respectively, during a brightness data writing period.

It is to be noted that while the second embodiment has been described by taking as a concrete example of the current bias circuit 47 the circuit whose fundamental configuration and operation are the same as those of the current bias circuit 16 according to the first concrete example of the first embodiment, the second embodiment is not limited to this example, and circuits of circuit configurations corresponding to the other concrete examples of the first embodiment or modifications thereof may also be used.

A gradation display method of an image display apparatus typified by the active matrix type organic EL display apparatus according to the first and second embodiments described above will next be described. Description in the following will be made by taking as an example a case where brightness data is given by an 8-bit digital signal.

Figure 21:
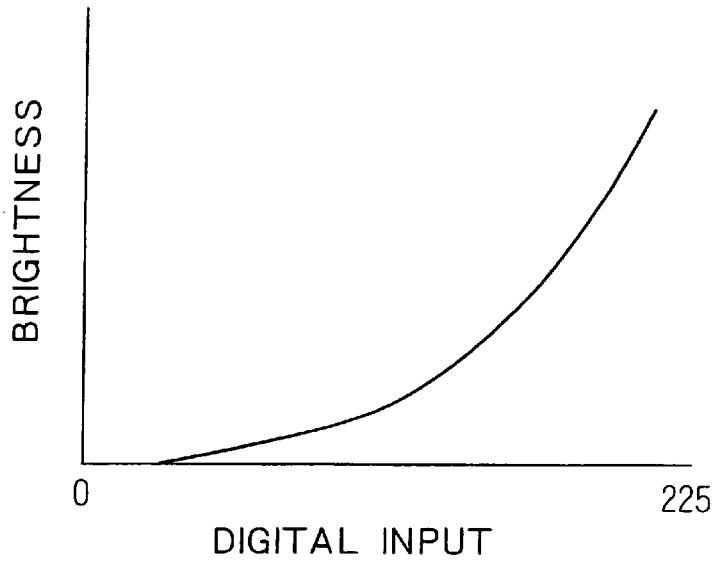
FIG. 21 is a characteristic diagram showing a gradation display characteristic generally considered to be desirable.
Figure 22:
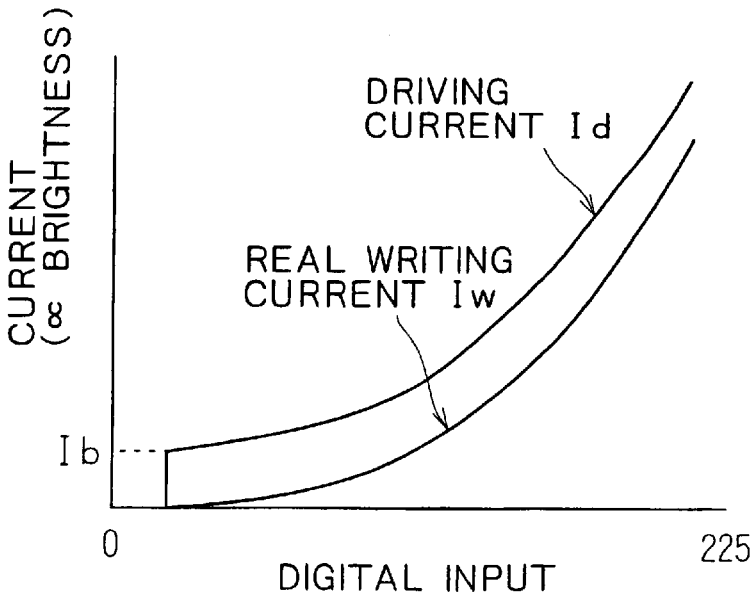
FIG. 22 is a characteristic diagram showing a gradation display characteristic according to the present invention.

FIG. 21 is a characteristic diagram showing a gradation display characteristic generally considered to be desirable. FIG. 22 is a characteristic diagram showing a gradation display characteristic according to the present invention. In the figures, the axis of abscissas indicates digital input value (0–255), whereas the axis of ordinates indicates brightness value or current value corresponding to the digital input value.

In the characteristic diagram of FIG. 21, when brightness data is given by an 8-bit digital signal, the value of displayable brightness is limited to 256 ($=2^8$) steps at a maximum. In this case, as shown in FIG. 21, display with smaller brightness steps at low brightness is known to be advantageous from a viewpoint of characteristics of human vision. Also, in order to enhance perceived contrast of an image, it is often better to set a few steps at a lowest brightness portion to substantially zero brightness irrespective of the input. FIG. 21 shows a characteristic resulting from these considerations (so-called γ curve characteristic)

On the other hand, in the characteristic diagram of FIG. 22, the current at a minimum input portion is substantially zero, as in FIG. 21, but the current at the other portion has a characteristic obtained by raising the characteristic of FIG. 21 by a bias current Ib (adding the bias current Ib to the characteristic of FIG. 21). In the active matrix type organic EL display apparatus according to the first and second embodiments, the current obtained by subtracting the bias current Ib from the driving current Id of the data line driving circuits 15 and 45 by the foregoing current bias circuits 16 and 47 is the real writing current Iw for the pixel circuits 11 and 41, so that the characteristic of the writing current Iw coincides with the characteristic of FIG. 22.

Figure 5:
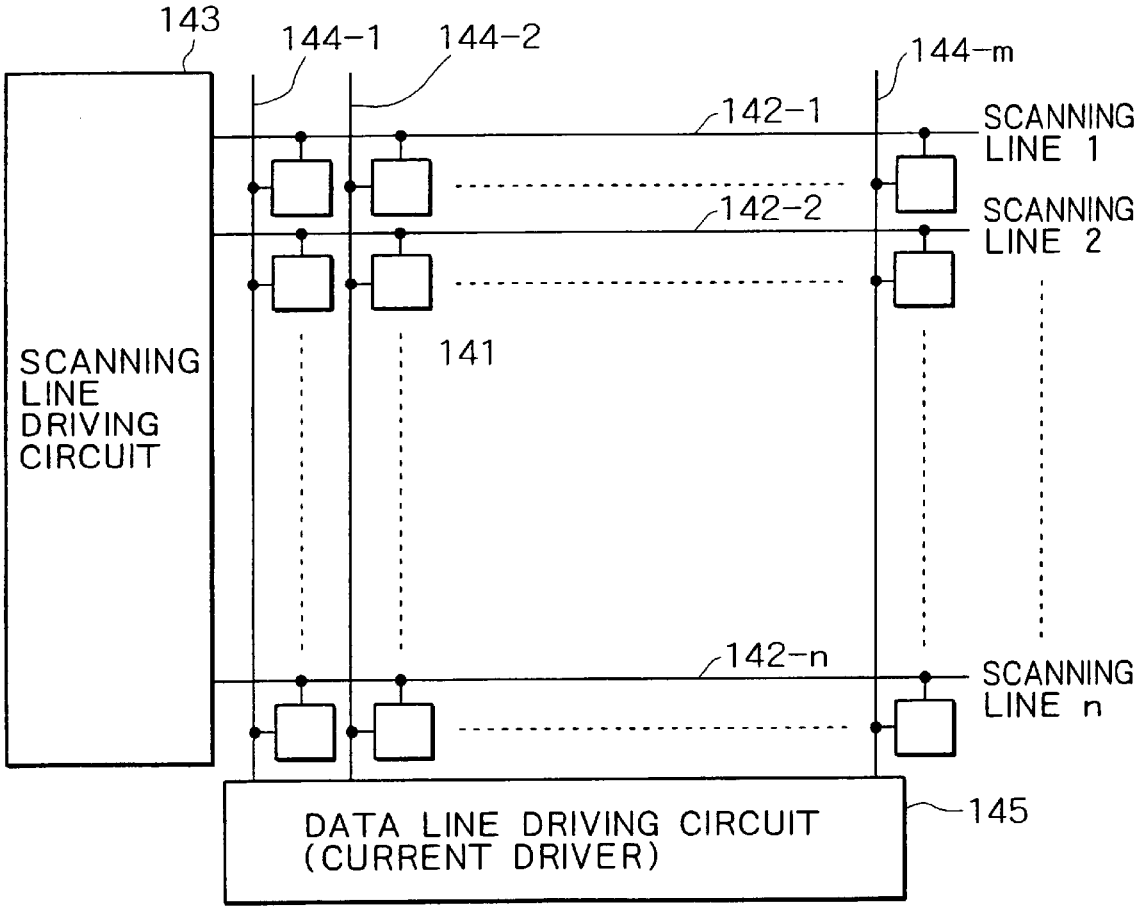
FIG. 5 is a block diagram showing an active matrix type display apparatus using the current writing type pixel circuit according to the conventional example.
Figure 6:
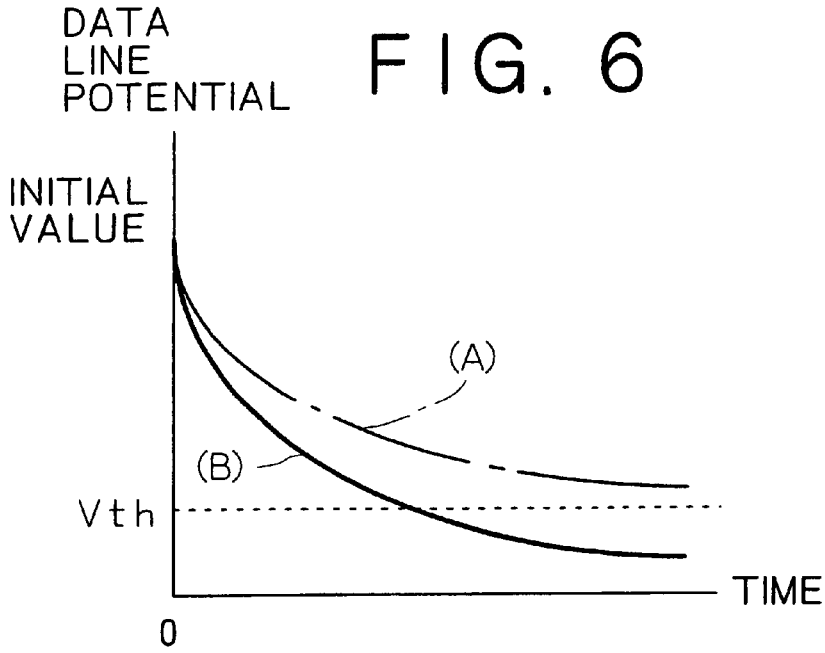
FIG. 6 is a diagram of assistance in explaining effect of a current bias circuit.

In the active matrix type organic EL display apparatus according to the conventional example in FIG. 5, luminous brightness of a pixel at least at a low brightness region is substantially in proportion to the writing current Iw. Therefore, the luminous brightness has the characteristic of FIG. 21, thus realizing desirable gradation display. In this case, a minimum current to be driven by the data line driving circuits 15 and 45 of the active matrix type organic EL display apparatus according to the first and second embodiments is the bias current Ib except for black (zero current). It is therefore not necessary to handle a very small current value extremely close to zero.

As described above, in the active matrix type organic EL display apparatus according to the first and second embodiments, the data line driving circuit for feeding the data lines with a current of a magnitude corresponding to brightness data feeds the data lines with a current obtained by adding substantially the value of the bias current Ib to the brightness data for display. Thus, even when the bias current Ib is set large, variations in an image as in the conventional example do not occur. It is therefore possible to reproduce gradation accurately at a low brightness region by adding in advance substantially the current value of the bias current Ib to the writing current.

More specifically, when the bias current Ib is added to the writing current Iw corresponding to the original brightness to be displayed and then written, the current bias circuits 16 and 47 feed a current of a magnitude Ib in a direction of canceling the bias current Ib, so that the current Iw flows to the pixel circuits 11 and 41 for display of the original gradation.

In this case, as viewed from the data line driving circuits 15 and 45 that feed the writing current Iw, Ib is a minimum current level except for black (zero current). Therefore, when writing data of low brightness close to black, it is not necessary to handle a very small current value close to zero, whereby high-speed and high-precision operation can be readily realized. When the writing current Iw is set to zero, the effect of the relatively great bias current Ib allows complete black to be written to a pixel quickly.

It is to be noted that the foregoing embodiments have been described by taking as an example a case where an organic EL device is used as a display device of a pixel, and a polysilicon thin film transistor is used as an active device of the pixel so that the present invention is applied to active matrix type organic EL display apparatus obtained by forming the organic EL device on a substrate where the polysilicon thin film transistor is formed; however, the present invention is not limited to this, and the present invention is applicable to an active matrix type display apparatus in general using current writing type pixel circuits supplied with brightness data in the form of current.

As described above, according to the present invention, a driving current in a direction of canceling a brightness data current is fed as a bias current through each of the data lines, and the value of the bias current is prevented from varying among the data lines. It is therefore possible to realize high-speed writing of low brightness data including black data and display an image without variations in brightness.

What is claimed is:

1. An active matrix type display apparatus comprising:

a pixel unit formed by arranging pixel circuits in a matrix manner, said pixel circuits each having an electrooptic device that changes brightness thereof according to a current flowing therein;

a data line driving circuit for supplying a writing current of a magnitude corresponding to brightness to each of said pixel circuits via a data line and thereby writing brightness data; and a current driving circuit provided for each data line for feeding the data line with a driving current in a direction of canceling said writing current;

wherein said current driving circuit includes:

a converting unit supplied with information of a value of the driving current to be fed in a form of a current, for converting the supplied current into a form of a voltage;

a retaining unit for retaining the voltage obtained by the conversion by said converting unit; and a driving unit for converting the voltage retained by said retaining unit into a current, and feeding the data line with the current as said driving current.

2. An active matrix type display apparatus as claimed in claim 1, wherein said converting unit includes a first insulated gate field-effect transistor for generating a voltage between a gate and a source thereof by being supplied with the information of the value of said driving current in the form of the current in a state where a drain and the gate of said first insulated gate field-effect transistor are electrically short-circuited;

said retaining unit includes a capacitor for retaining the voltage generated between the gate and the source of said first insulated gate field-effect transistor; and said driving unit includes a second insulated gate field-effect transistor for feeding the data line with said driving current on the basis of the voltage retained by said capacitor.

3. An active matrix type display apparatus as claimed in claim 2, wherein said converting unit includes a first switch device for selectively supplying said first insulated gate field-effect transistor with the information of the value of said driving current in the form of the current; and said retaining unit includes a second switch device for selectively supplying said capacitor with the voltage generated between the gate and the source of said first insulated gate field-effect transistor and going into a non-conducting state prior to said first switch device.

4. An active matrix type display apparatus as claimed in claim 2, wherein said first insulated gate field-effect transistor and said second insulated gate field-effect transistor are an identical transistor.

5. An active matrix type display apparatus as claimed in claim 2, wherein said first insulated gate field-effect transistor and said second insulated gate field-effect transistor are two different transistors disposed adjacent to each other.

6. An active matrix type display apparatus as claimed in claim 1, wherein the information of the value of said driving current is supplied to said current driving circuit via said data line.

7. An active matrix type display apparatus as claimed in claim 1, wherein the information of the value of said driving current is supplied to said current driving circuit during a period when no data is written to said pixel circuits.

8. An active matrix type display apparatus as claimed in claim 1, wherein two said data line driving circuits are provided for each data line, and while one data line driving circuit drives the data line, the other data line driving circuit captures image information; and two said current driving circuits are provided for each data line, and the two current driving circuits operate in synchronism with operations of said two data line driving circuits during a brightness data writing period.

9. An active matrix type display apparatus as claimed in claim 1, wherein said data line driving circuit feeds the data line with a writing current obtained by adding substantially the value of said driving current to the brightness data to be displayed.

10. A driving method of an active matrix type display apparatus, said active matrix type display apparatus including: a pixel unit formed by arranging current writing type pixel circuits in a matrix manner, said pixel circuits each using, as a display device, an electrooptic device that changes brightness thereof according to a current flowing therein; a data line driving circuit for supplying a writing current of a magnitude corresponding to brightness to each of said pixel circuits via a data line and thereby writing brightness data; and a current driving circuit provided for each data line for feeding the data line with a driving current in a direction of canceling said writing current, wherein said driving method characterized in that said current driving circuit is supplied with information of a value of the driving current to be fed in a form of a current during a period when the brightness data is not written to said pixel circuits and said current driving circuit retains the current in a form of a voltage; and subsequently a current corresponding to the retained voltage is fed to the data line as said driving current from said current driving circuit when the brightness data is written to said pixel circuits.

11. An active matrix type organic electroluminescence display apparatus comprising:

a pixel unit formed by arranging pixel circuits in a matrix manner, said pixel circuits each having an organic electroluminescence device with a first electrode, a second electrode, and an organic layer including a light emitting layer between the first electrode and the second electrode;

a data line driving circuit for supplying a writing current of a magnitude corresponding to brightness to each of said pixel circuits via a data line and thereby writing brightness data; and a current driving circuit provided for each data line for feeding the data line with a driving current in a direction of canceling said writing current;

wherein said current driving circuit includes:

a converting unit supplied with information of a value of the driving current to be fed in a form of a current, for converting the supplied current into a form of a voltage;

a retaining unit for retaining the voltage obtained by the conversion by said converting unit; and a driving unit for converting the voltage retained by said retaining unit into a current, and feeding the data line with the current as said driving current.

12. An active matrix type organic electroluminescence display apparatus as claimed in claim 11, wherein the information of the value of said driving current is supplied to said current driving circuit via said data line.

13. An active matrix type organic electroluminescence display apparatus as claimed in claim 11, wherein the information of the value of said driving current is supplied to said current driving circuit during a period when no data is written to said pixel circuits.

14. An active matrix type organic electroluminescence display apparatus as claimed in claim 11, wherein two said data line driving circuits are provided for each data line, and while one data line driving circuit drives the data line, the other data line driving circuit captures image information; and two said current driving circuits are provided for each data line, and the two current driving circuits operate in synchronism with operations of said two data line driving circuits during a brightness data writing period.

15. An active matrix type organic electroluminescence display apparatus as claimed in claim 11, wherein said data line driving circuit feeds the data line with a current obtained by adding substantially the value of said driving current to the brightness data to be displayed.

16. An active matrix type organic electroluminescence display apparatus as claimed in claim 11, wherein said converting unit includes a first insulated gate field-effect transistor for generating a voltage between a gate and a source thereof by being supplied with the information of the value of said driving current in the form of the current in a state where a drain and the gate of said first insulated gate field-effect transistor are electrically short-circuited;

said retaining unit includes a capacitor for retaining the voltage generated between the gate and the source of said first insulated gate field-effect transistor; and said driving unit includes a second insulated gate field-effect transistor for feeding the data line with said driving current on the basis of the voltage retained by said capacitor.

17. An active matrix type organic electroluminescence display apparatus as claimed in claim 16, wherein said converting unit includes a first switch device for selectively supplying said first insulated gate field-effect transistor with the information of the value of said driving current in the form of the current; and said retaining unit includes a second switch device for selectively supplying said capacitor with the voltage generated between the gate and the source of said first insulated gate field-effect transistor and going into a non-conducting state prior to said first switch device.

18. An active matrix type organic electroluminescence display apparatus as claimed in claim 16, wherein said first insulated gate field-effect transistor and said second insulated gate field-effect transistor are an identical transistor.

19. An active matrix type organic electroluminescence display apparatus as claimed in claim 16, wherein said first insulated gate field-effect transistor and said second insulated gate field-effect transistor are two different transistors disposed adjacent to each other.

20. A driving method of an active matrix type organic electroluminescence display apparatus, said active matrix type organic electroluminescence display apparatus including: a pixel unit formed by arranging current writing type pixel circuits in a matrix manner, said pixel circuits each using, as a display device, an electrooptic device that changes brightness thereof according to a current flowing therein; a data line driving circuit for supplying a writing current of a magnitude corresponding to brightness to each of said pixel circuits via a data line and thereby writing brightness data; and a current driving circuit provided for each data line for feeding the data line with a driving current in a direction of canceling said writing current, wherein said driving method characterized in that:

said current driving circuit is supplied with information of a value of the driving current to be fed in a form of a current during a period when the brightness data is not written to said pixel circuits and said current driving circuit retains the current in a form of a voltage; and subsequently a current corresponding to the retained voltage is fed to the data line as said driving current from said current driving circuit when the brightness data is written to said pixel circuits.

* * * * *